US005445566A

United States Patent [19]

Hayes

[11] Patent Number: 5,445,566

[45] Date of Patent: Aug. 29, 1995

[54] BOWLING WRIST AND HAND SUPPORT

[76] Inventor: Lonnie Hayes, 6471 Sunset La., Indianapolis, Ind. 46260

[21] Appl. No.: 314,796

[22] Filed: Sep. 29, 1994

[51] Int. Cl.[6] ..... A63B 69/00

[52] U.S. Cl. ..... 473/62; 2/917; 2/161.1; 2/162; 2/170

[58] Field of Search ..... 473/55, 59, 60, 61, 473/62, 63; 2/161 A, 162

[56] References Cited

U.S. PATENT DOCUMENTS

| | | | |
|---|---|---|---|
| 3,606,319 | 12/1969 | Borden | 473/61 |
| 3,790,168 | 2/1974 | Hashimoto | 473/62 |
| 4,047,250 | 9/1977 | Norman | 473/62 |
| 4,138,108 | 2/1979 | Robinson | 473/62 |
| 4,228,548 | 10/1980 | Cohen | 473/62 |
| 4,374,439 | 2/1983 | Norman | 473/62 |
| 5,014,689 | 5/1991 | Meunchen et al. | 473/62 |

*Primary Examiner*—Vincent Millin
*Assistant Examiner*—William M. Pierce

[57] ABSTRACT

A new and improved bowling wrist and hand support device having a securement means theresecured for securement around a user's wrist and hand. The support has an appendage aperture formed therethrough. The appendage aperture serves to receive a user's thumb therethrough. A first metal strip is secured within an inner portion of the wrist and hand support. The first metal strip functions to prevent the user's wrist from bending forward. A second metal strip is secured within an inner portion of the wrist and hand support. The second metal strip functions to prevent the user's wrist from bending backwards. A rubber wedge is secured within an inner portion of the wrist and hand support. The rubber wedge functions to balance a bowling bowl in the user's hand.

1 Claim, 4 Drawing Sheets

FIG 1
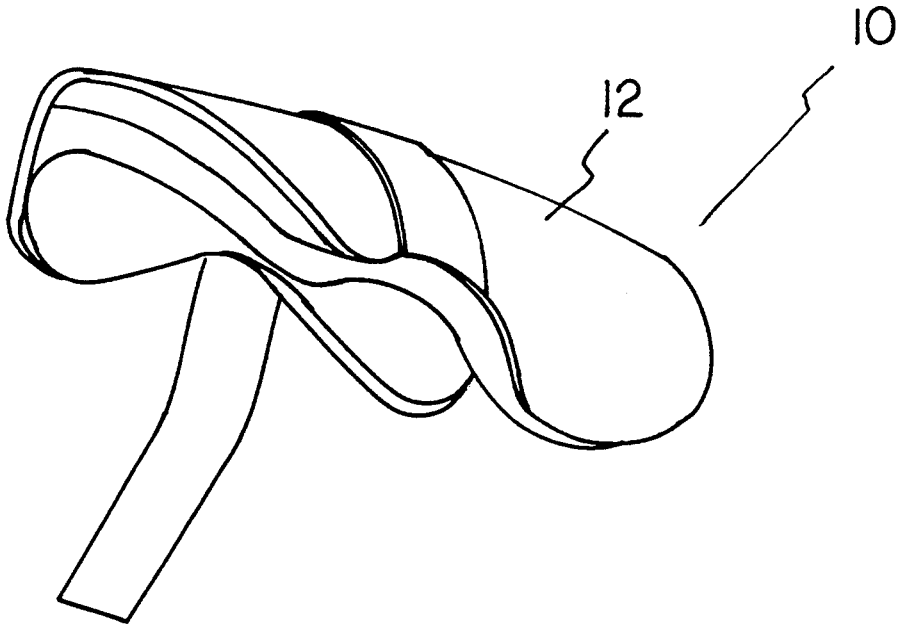
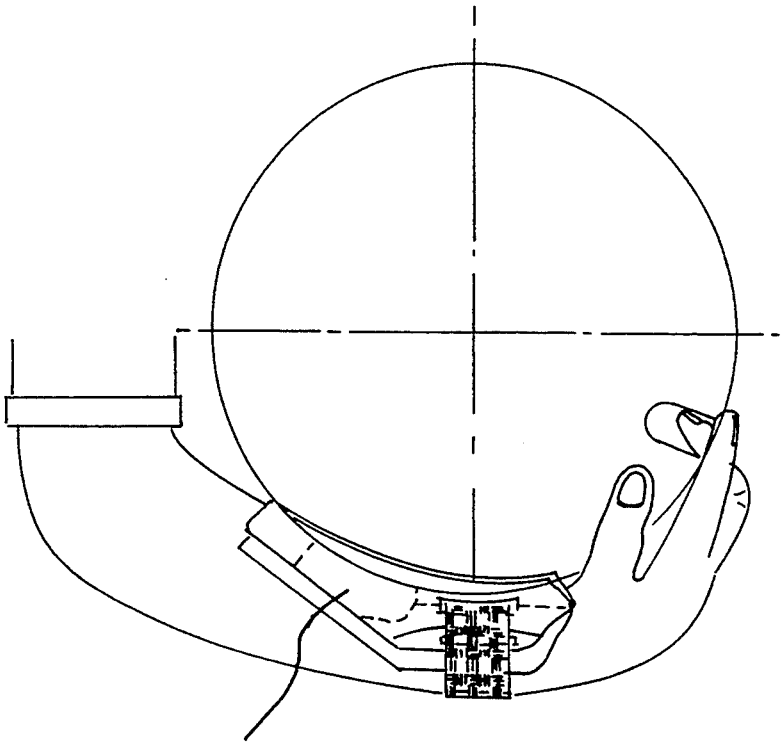
FIG 2

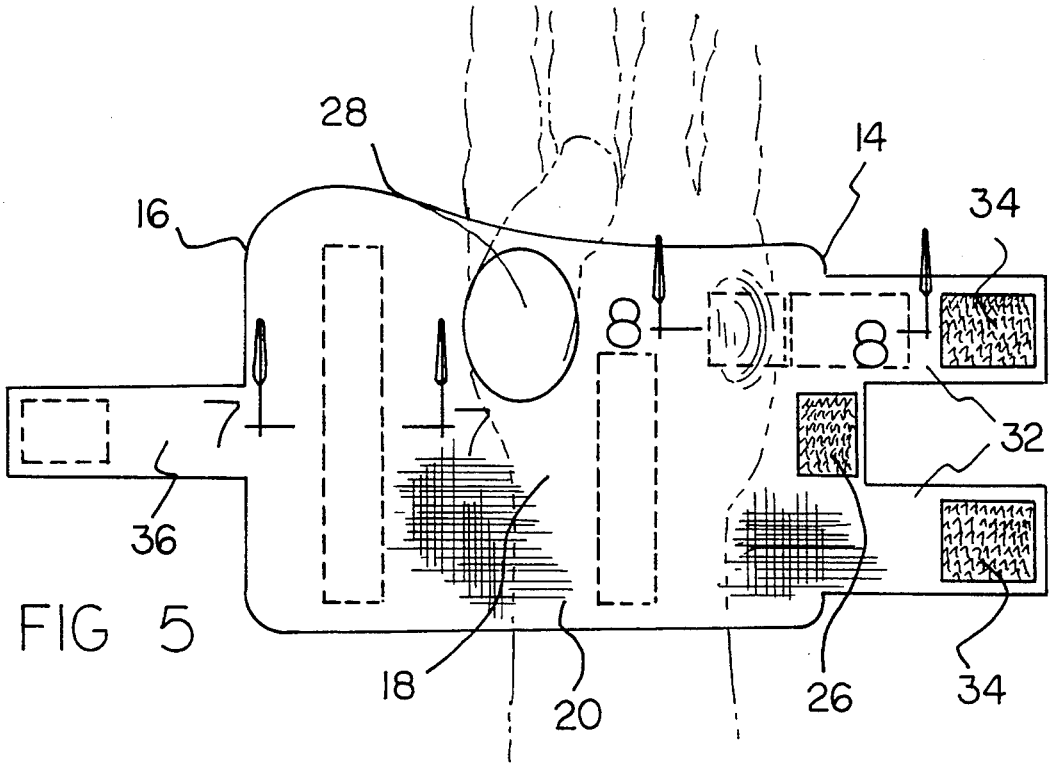
FIG 5
FIG 6
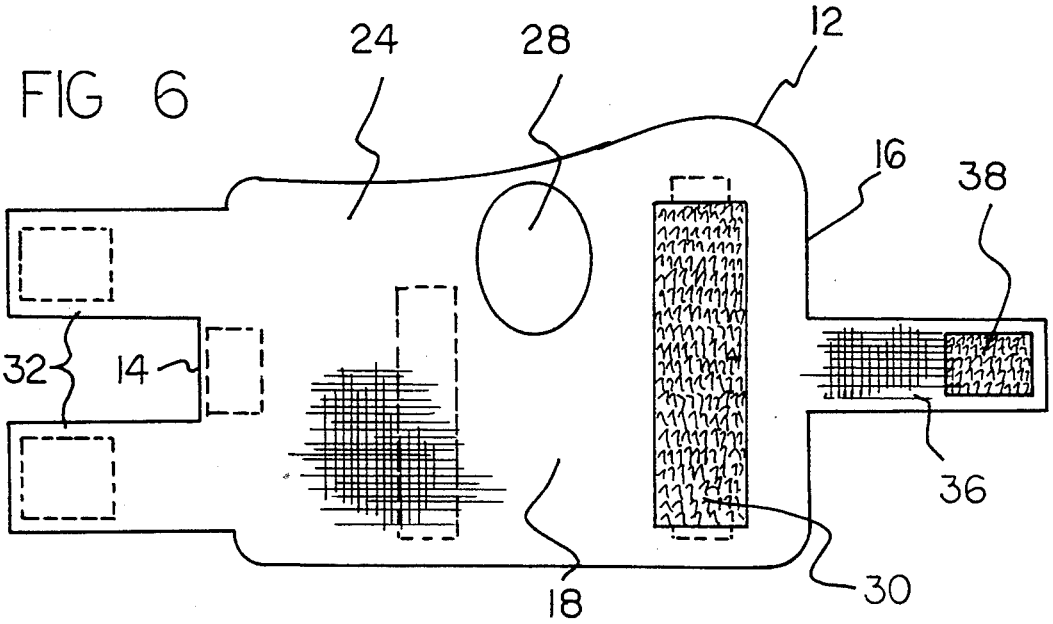

FIG 7
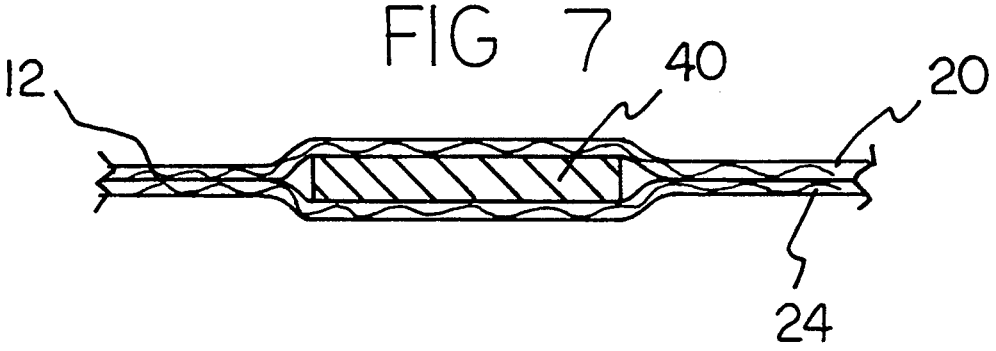
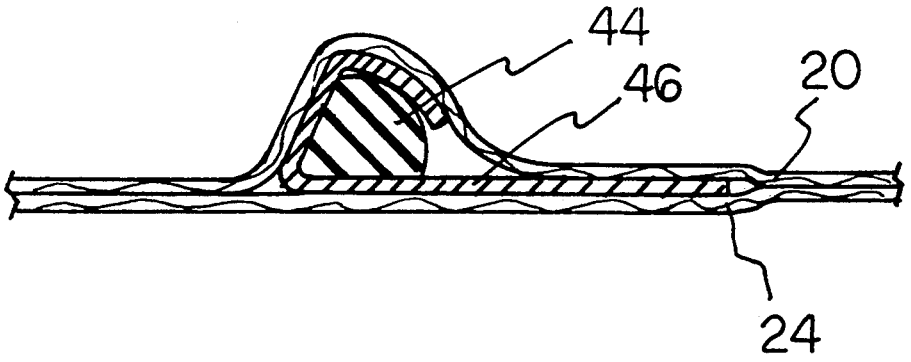
FIG 8

BOWLING WRIST AND HAND SUPPORT

BACKGROUND OF THE INVENTION

1. Field of the Invention

The present invention relates to a bowling wrist and hand support device and more particularly pertains to maintaining the wrist and hand in the proper position when delivering a bowling ball with a bowling wrist and hand support device.

2. Description of the Prior Art

The use of wrist supports is known in the prior art. More specifically, wrist supports heretofore devised and utilized for the purpose of providing support for wrists are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,925,187 to Fleenor et al. discloses a bowling hand and wrist support device.

U.S. Pat. No. 5,201,874 to Kiehn discloses a bowling ball support for the forearm.

U.S. Pat. No. 3,815,908 to Hashimoto discloses a bowler's wrist support.

U.S. Pat. No. 3,829,090 to Ensinger discloses an adjustable wrist support for bowling.

U.S. Pat. No. 4,441,711 to Dubar et al. discloses a wrist and ring finger support for bowler.

While these devices fulfill their respective, particular objective and requirements, the aforementioned patents do not describe a bowling wrist and hand support device for maintaining the wrist and hand in the proper position when delivering a bowling ball.

In this respect, the bowling wrist and hand support device according to the present invention substantially departs from the conventional concepts and designs of the prior art, and in doing so provides an apparatus primarily developed for the purpose of maintaining the wrist and hand in the proper position when delivering a bowling ball.

Therefore, it can be appreciated that there exists a continuing need for new and improved bowling wrist and hand support device which can be used for maintaining the wrist and hand in the proper position when delivering a bowling ball. In this regard, the present invention substantially fulfills this need.

SUMMARY OF THE INVENTION

In the view of the foregoing disadvantages inherent in the known types of wrist supports now present in the prior art, the present invention provides an improved bowling wrist and hand support device. As such, the general purpose of the present invention, which will be described subsequently in greater detail, is to provide a new and improved bowling wrist and hand support device and method which has all the advantages of the prior art and none of the disadvantages.

To attain this, the present invention essentially comprises a wrist and hand support having a first end, a second end, an intermediate extent therebetween, a front surface, and a back surface. The front surface has a Velcro square patch theresecured inward of the first end. An appendage aperture is formed through the intermediate extent. The appendage aperture serves to receive a user's thumb therethrough. The back surface has an oblong Velcro patch theresecured inward of the second end. A dual extent strap is integral with the first end. The front surface of the dual extent strap has a pair of Velcro square patches theresecured. The pair of Velcro square patches correspond with the oblong Velcro patch to help secure the support to the user. A strap is integral with the second end. The back surface of the strap has a Velcro square patch theresecured. The Velcro square patch corresponds with the Velcro square patch of the front surface to help secure the support to the user's wrist and hand. The device contains a first metal strip secured within an inner portion of the wrist and hand support. The first metal strip is positioned at a point between the first end and the appendage aperture. The first metal strip functions to prevent the user's wrist from bending forward. The device contains a second metal strip secured within an inner portion of the wrist and hand support. The second metal strip is positioned at a point between the second end and the appendage aperture of the wrist and hand support. The second metal strip functions to prevent the user's wrist from bending backwards. The device contains a rubber wedge secured within an inner portion of the wrist and hand support. The rubber wedge is secured therein by a third metal strip. The rubber wedge is positioned inward of the first end of the wrist and hand support and diametrically opposed from the appendage aperture thereof. The rubber wedge functions to balance a bowling bowl in the user's hand.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bowling wrist and hand support device which has all the advantages of the prior art wrist supports and none of the disadvantages.

It is another object of the present invention to provide a new and improved bowling wrist and hand support device which may be easily and efficiently manufactured and marketed.

It is a further object of the present invention to provide a new and improved bowling wrist and hand support device which is of durable and reliable construction.

An even further object of the present invention is to provide a new and improved bowling wrist and hand support device which is susceptible of a low cost of manufacture with regard to both materials and labor, and which accordingly is then susceptible of low prices of sale to the consuming public, thereby making such a bowling wrist and hand support device economically available to the buying public.

Still yet another object of the present invention is to provide a new and improved bowling wrist and hand support device which provides in the apparatuses and methods of the prior art some of the advantages thereof, while simultaneously overcoming some of the disadvantages normally associated therewith.

Even still another object of the present invention is to provide a new and improved bowling wrist and hand support device for maintaining the wrist and hand in the proper position when delivering a bowling ball.

Lastly, it is an object of the present invention to provide a new and improved bowling wrist and hand support device having a securement means theresecured for securement around a user's wrist and hand. The support has an appendage aperture formed therethrough. The appendage aperture serves to receive a user's thumb therethrough. A first metal strip is secured within an inner portion of the wrist and hand support. The first metal strip functions to prevent the user's wrist from bending forward. A second metal strip is secured within an inner portion of the wrist and hand support. The second metal strip functions to prevent the user's wrist from bending backwards. A rubber wedge is secured within an inner portion of the wrist and hand support. The rubber wedge functions to balance a bowling bowl in the user's hand.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the bowling wrist and hand support device constructed in accordance with the principles of the present invention.

FIG. 2 is a side view of the present invention illustrated in place on a user's wrist and hand while holding a bowling ball.

FIG. 5 is a plan view of the present invention illustrating the front portion.

FIG. 6 is a plan view of the present invention illustrating the back portion.

FIG. 7 is a cross-sectional view of the present invention taken along line 7—7 of FIG. 5.

FIG. 8 is a cross-sectional view of the present invention taken along line 8—8 of FIG. 5.

The same reference numerals refer to the same parts through the various Figures.

DESCRIPTION OF THE PREFERRED EMBODIMENT

Figure 3:
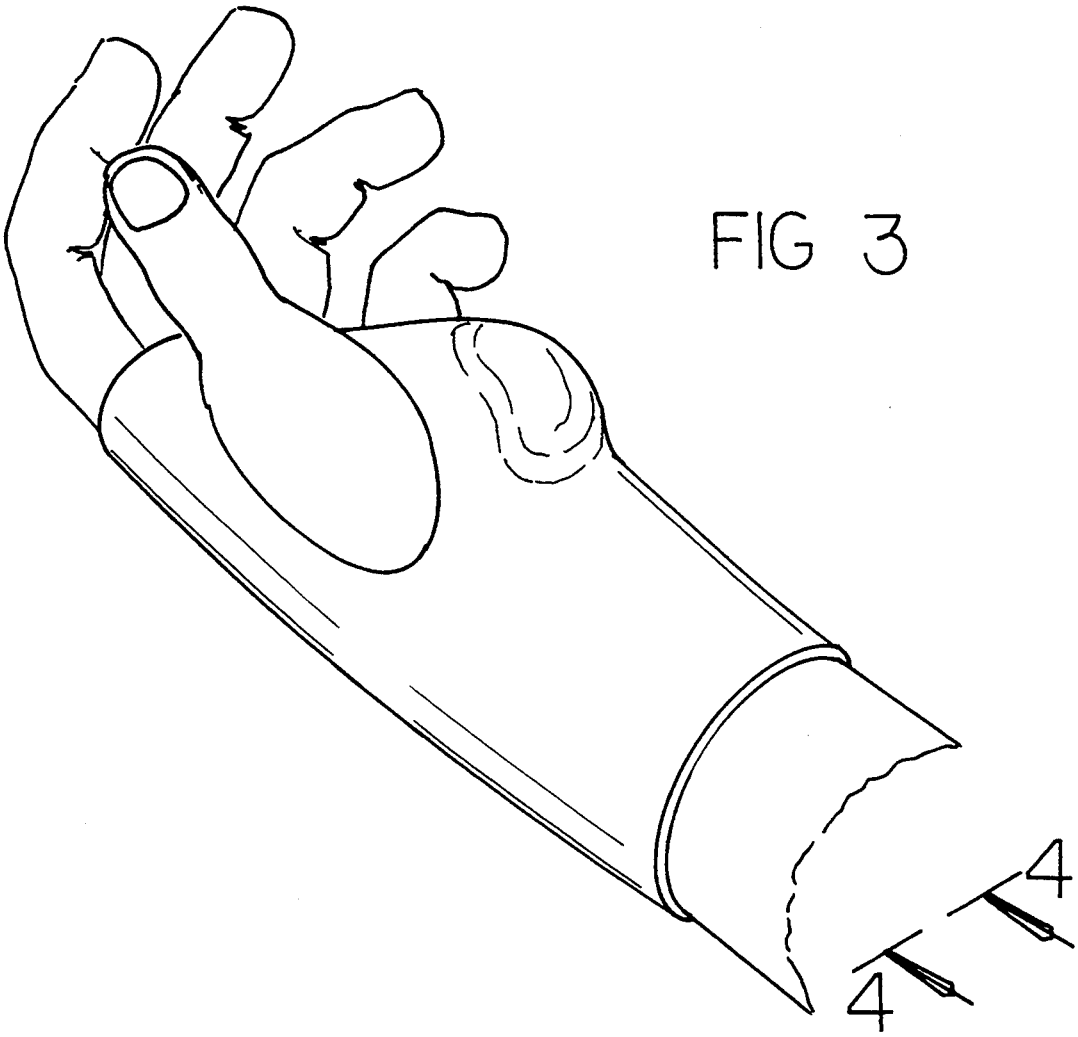
FIG. 3 is a perspective view of the present invention illustrated in place on a users wrist and hand.
Figure 4:
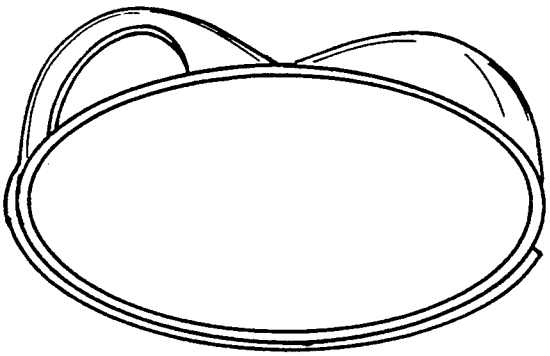
FIG. 4 is an elevated sectional view of the present invention taken along line 4—4 of FIG. 3.

With reference now to the drawings, and in particular, to FIG. 1 thereof, the preferred embodiment of the new and improved bowling wrist and hand support device embodying the principles and concepts of the present invention and generally designated by the reference number 10 will be described.

Specifically, it will be noted in the various Figures that the device relates to a new and improved bowling wrist and hand support device for maintaining the wrist and hand in the proper position when delivering a bowling ball. In its broadest context, the device consists of a wrist and hand support, a first metal strip, a second metal strip, and a rubber wedge.

The device 10 contains a wrist and hand support 12 having a first end 14, a second end 16, an intermediate extent 18 therebetween, a front surface 20, and a back surface 24. The front surface 20 has a Velcro square patch 26 theresecured inward of the first end 14. An appendage aperture 28 is formed through the intermediate extent 18. The appendage aperture 28 serves to receive a user's thumb therethrough. The back surface 24 has an oblong Velcro patch 30 theresecured inward of the second end 16. A dual extent strap 32 is integral with the first end 14. The front surface 20 of the dual extent strap 32 has a pair of Velcro square patches 34 theresecured. The pair of Velcro square patches 34 correspond with the oblong Velcro patch 30 to help secure the support to the user. A strap 36 is integral with the second end 16. The back surface 24 of the strap 36 has a Velcro square patch 38 theresecured. The Velcro square patch 38 corresponds with the Velcro square patch 26 of the front surface 20 to help secure the support 12 to the user's wrist and hand.

The device 10 contains a first metal strip 40 secured within an inner portion of the wrist and hand support 12. The first metal strip 40 is positioned at a point between the first end 14 and the appendage aperture 28. The first metal strip 40 functions to prevent the user's wrist from bending forward.

The device 10 contains a second metal strip 42 secured within an inner portion of the wrist and hand support 12. The second metal strip 42 is positioned at a point between the second end 16 and the appendage aperture 28 of the wrist and hand support 12. The second metal strip 42 functions to prevent the user's wrist from bending backwards.

The device 10 contains a rubber wedge 44 secured within an inner portion of the wrist and hand support 12. The rubber wedge 44 is secured therein by a third metal strip 46. The rubber wedge 44 is positioned inward of the first end 14 of the wrist and hand support 12 and diametrically opposed from the appendage aperture 28 thereof. The rubber wedge 44 functions to balance a bowling bowl in the user's hand.

The present invention is a bowler's wrist band which has a wedge 44 in the palm to steady the heavy bowling ball so it does not twist the hand during the delivery.

The wedge 44 is located in the palm, above the little finger and maintained in position by a metal band 46 that extends around that portion of the hand. It is shaped to prevent the ball from rolling, being molded in rubber and incorporated directly into the glove which is made of leather. A hole in the metal band 46 prevents it from becoming dislodged. In most other respects, the glove is similar to many of those which are now available, with metal strips 40,42 at the front and back of the wrist so it does not hinge back and forth on the backswing and the forward delivery. Hook and loop strips are used to attach the glove on the wrist and the hand.

Professionals strive to maintain the ball in one position throughout the movement of the arm. Usually, that is with the thumb in what is called the ten o'clock location, when related to the face of a clock. However, most bowlers do not have sufficient strength in the fingers, hand and wrist to accomplish this.

The wedge 44 in this glove assists them in preventing the weight of the ball from causing the hand to twist so the thumb turns inwardly toward the ground. It enables them to consistently control the action of the ball as it rolls down the alley.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved bowling wrist and hand support device for maintaining the wrist and hand in the proper position when delivering a bowling ball comprising, in combination:

a wrist and hand support having a first end, a second end, an intermediate extent therebetween, a front surface, and a back surface, the front surface having a Velcro square patch theresecured inward of the first end, an appendage aperture formed through the intermediate extent, the appendage aperture serving to receive a user's thumb therethrough, the back surface having an oblong Velcro patch theresecured inward of the second end, two spaced apart straps integral with the first end, a front surface of the two spaced apart straps having a pair of Velcro square patches theresecured, the pair of Velcro square patches corresponding with the oblong Velcro patch to help secure the support to the user, a strap integral with the second end, the back surface of the strap having a Velcro square patch theresecured, the Velcro square patch corresponding with the Velcro square patch of the front surface to help secure the support to the user's wrist and hand;

a first metal strip secured within an inner portion of the wrist and hand support, the first metal strip positioned at a point between the first end and the appendage aperture, the first metal strip functioning to prevent the user's wrist from bending forward;

a second metal strip secured within an inner portion of the wrist and hand support, the second metal strip positioned at a point between the second end and the appendage aperture of the wrist and hand support, the second metal strip functioning to prevent the user's wrist from bending backwards;

a rubber wedge secured within an inner portion of the wrist and hand support, the rubber wedge secured therein by a third metal strip, the third metal strip formed around the rubber wedge, the third metal strip and the rubber wedge extending outwardly of the inner portion of the wrist and hand support, the rubber wedge positioned inward of the first end of the wrist and hand support and diametrically opposed from the appendage aperture thereof, the rubber wedge positioned below a little finger of a user when the wrist and hand support is secured to the user's wrist and hand, the rubber wedge functioning to balance a bowling bowl in the user's hand.

* * * * *